US011033805B2

(12) United States Patent
Bernal

(10) Patent No.: US 11,033,805 B2
(45) **Date of Patent: *Jun. 15, 2021**

(54) TOY PROJECTILE

(71) Applicant: HASBRO, INC., Pawtucket, RI (US)

(72) Inventor: Dennis Bernal, Milford, MA (US)

(73) Assignee: HASBRO, INC., Pawtucket, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/828,789

(22) Filed: Mar. 24, 2020

(65) Prior Publication Data

US 2020/0306621 A1 Oct. 1, 2020

Related U.S. Application Data

(60) Provisional application No. 62/901,777, filed on Sep. 17, 2019, provisional application No. 62/865,702, filed on Jun. 24, 2019, provisional application No. 62/824,003, filed on Mar. 26, 2019.

(51) Int. Cl.

| | |
|---|---|
| ***F42B 6/06*** | (2006.01) |
| ***A63B 65/02*** | (2006.01) |
| ***A63F 9/02*** | (2006.01) |
| ***F42B 6/00*** | (2006.01) |

(52) U.S. Cl.

CPC ..... *A63F 9/0278* (2013.01); *F42B 6/003* (2013.01); *F42B 6/06* (2013.01); *A63F 2009/0282* (2013.01)

(58) Field of Classification Search

CPC .... F42B 6/003; F42B 6/02; F42B 6/04; F42B 6/06; F42B 6/08

See application file for complete search history.

(56) References Cited

U.S. PATENT DOCUMENTS

| | | | | |
|---|---|---|---|---|
| 1,441,975 | A | 1/1923 | Edelin | |
| 1,488,995 | A | 4/1924 | McCollom | |
| 2,499,029 | A * | 2/1950 | McElroy | F42B 6/003 473/585 |
| 2,737,942 | A | 3/1956 | Horowitz et al. | |
| 2,828,965 | A * | 4/1958 | Schwitzki | F42B 6/04 473/586 |
| 3,054,536 | A | 9/1962 | Sagarin | |
| 3,059,928 | A * | 10/1962 | Flanagan | F42B 6/003 273/408 |
| 3,420,133 | A | 1/1969 | Proll | |
| 3,990,426 | A | 11/1976 | Stokes | |
| 4,170,215 | A | 10/1979 | Kettlestrings | |
| 4,212,285 | A | 7/1980 | Cagan et al. | |
| 4,248,202 | A | 2/1981 | Jaworski et al. | |
| 4,659,320 | A | 4/1987 | Rich et al. | |

(Continued)

OTHER PUBLICATIONS

European Patent Application No. 20165549.5, Extended European Search Report, dated Aug. 25, 2020.

(Continued)

*Primary Examiner* — John A Ricci

(74) *Attorney, Agent, or Firm* — Marshall, Gerstein & Borun LLP

(57) ABSTRACT

In accordance with embodiments a projectile can have a body and a tip attached to the body, the body including a nub portion extending from a second end of the body and optionally one or more fins surrounding a circumference of the body at the second end.

30 Claims, 21 Drawing Sheets

(56) References Cited

U.S. PATENT DOCUMENTS

| | | | | |
|---|---|---|---|---|
| 4,841,945 | A | 6/1989 | Braden | |
| 4,890,404 | A | 1/1990 | Ferri | |
| 5,156,137 | A | 10/1992 | Clayton | |
| 5,165,383 | A | 11/1992 | Ebert et al. | |
| 5,186,156 | A | 2/1993 | Clayton | |
| 5,205,271 | A | 4/1993 | Casas Salva | |
| 5,471,967 | A | 12/1995 | Matsuzaki et al. | |
| 5,529,050 | A | 6/1996 | D'Andrade | |
| 5,575,270 | A | 11/1996 | Casas-Salva | |
| 6,488,019 | B2 | 12/2002 | Kotsiopoulos | |
| 6,523,535 | B2 | 2/2003 | Rehkemper et al. | |
| 6,595,880 | B2 * | 7/2003 | Becker | F42B 6/04 124/44.5 |
| 7,051,727 | B2 | 5/2006 | Wu | |
| 7,228,802 | B2 * | 6/2007 | Montefusco | F42B 8/16 102/501 |
| 7,849,627 | B2 | 12/2010 | Wygant | |
| 8,082,909 | B2 | 12/2011 | Sopinsky et al. | |
| 8,127,753 | B1 | 3/2012 | Brooks et al. | |
| 8,397,705 | B2 | 3/2013 | DeHaan et al. | |
| 8,567,378 | B2 | 10/2013 | Nugent | |
| 8,695,579 | B2 | 4/2014 | Huebl | |
| 8,875,688 | B2 | 11/2014 | Nugent | |
| 8,955,503 | B2 | 2/2015 | Corsiglia et al. | |
| 8,967,130 | B2 | 3/2015 | Victor et al. | |
| 9,027,541 | B2 | 5/2015 | Huebl | |
| 9,097,484 | B2 | 8/2015 | Poirier | |
| 9,194,646 | B2 | 11/2015 | Victor et al. | |
| 9,389,042 | B1 | 7/2016 | Clayton | |
| 9,459,081 | B2 * | 10/2016 | Chia | F42B 6/08 |
| 9,500,432 | B2 | 11/2016 | Chia | |
| 9,958,230 | B1 | 5/2018 | Nugent et al. | |
| 10,408,583 | B2 * | 9/2019 | Isenmann | F42B 12/745 |
| 10,408,584 | B2 * | 9/2019 | Isenmann | F42B 6/08 |
| 10,551,156 | B2 * | 2/2020 | Chia | F42B 6/08 |
| 2002/0166551 | A1 | 11/2002 | Lee | |
| 2006/0004687 | A1 | 1/2006 | Boyd et al. | |
| 2006/0046877 | A1 * | 3/2006 | Gajda, Jr. | F42B 6/10 473/572 |
| 2009/0050127 | A1 | 2/2009 | Wygant | |
| 2009/0095272 | A1 | 4/2009 | Zimmerman | |
| 2010/0206281 | A1 | 8/2010 | Kanitz et al. | |
| 2011/0017476 | A1 | 1/2011 | Fuchs | |
| 2011/0174768 | A1 * | 7/2011 | Yarro | B65D 81/365 215/382 |
| 2013/0112184 | A1 | 5/2013 | Corsiglia et al. | |
| 2013/0239938 | A1 | 9/2013 | Nugent | |
| 2013/0312722 | A1 | 11/2013 | Price | |
| 2014/0352677 | A1 | 12/2014 | Chia | |
| 2015/0030878 | A1 | 1/2015 | Zhi | |
| 2015/0308782 | A1 | 10/2015 | Chia | |
| 2018/0029218 | A1 | 2/2018 | Epicureo | |
| 2018/0051966 | A1 | 2/2018 | Isenmann | |
| 2018/0292189 | A1 * | 10/2018 | Isenmann | F42B 6/08 |

OTHER PUBLICATIONS

Extended European Search Report, European Patent Application No. 20165546.1, dated Aug. 20, 2021.

International Application No. PCT/US2020/024422, International Search Report and Written Opinion, dated Jul. 27, 2020.

International Application No. PCT/US2020/024415, International Search Report and Written Opinion, dated Jul. 21, 2020.

International Application No. PCT/US2020/024401, International Search Report and Written Opinion, dated Jul. 27, 2020.

* cited by examiner

TOY PROJECTILE

CROSS-REFERENCE TO RELATED APPLICATIONS

This application claims the benefit of priority of U.S. Provisional Application No. 62/824,003 filed Mar. 26, 2019, U.S. Provisional Application No. 62/865,702 filed Jun. 24, 2019, and U.S. Provisional Application No. 62/901,777 filed Sep. 17, 2019, the respective disclosures of which are incorporated herein by reference in their entireties.

BACKGROUND

Various projectile toys exist on the market, such as darts, discs, arrows, and balls. Conventionally such projectile toys are foam structures made from extruded foamed materials, such as polyurethanes and polyethylenes. Such toy projectiles are be designed to be discharged with sufficient force for desired flight characteristics, while maintaining safe impact force when hitting a target to avoid injury to the users. The softness required for safety standards can run contrary to the needs for providing desired flight characteristics, such as distance, accuracy, and precision.

SUMMARY

In accordance with embodiments, a toy projectile can include a body extending from a first end to a second end, wherein the body has a substantially cylindrical body; a nub portion extending from the second end, the nub portion having a diameter smaller than a diameter of the body at the second end, such that a step is defined between the second end and the nub portion; a tip attached to the body at the first end; and one or more fins attached to or integrally formed with the body at the second end upstream the nub portion.

In accordance with embodiments, a toy projectile can include a body extending from a first end to a second end, wherein the body has a boat tail structure, tapering towards the second end to define a nub portion; one or more fins disposed on the body adjacent the second end around a circumference of the body; wherein the one or more fins terminate at fin ends upstream the nub portion, such that the nub portion extends outwardly defining a reduced circumferential portion as compared to an outer circumference defined by the one or more fins and step defined between the fin ends and the nub portion.

In accordance with embodiments, a toy projection can include a body extending from a first end to a second end; a plurality of fins attached to or integrally formed with the body at the second end, wherein the body including the fins has a generally cylindrical shaped with a first diameter, each fin being separated from adjacent fins by a space, wherein a portion of the body disposed in the space is tapered inwardly along a length of the fin towards the second end; a nub portion extending from the second end, wherein nub portion has a second diameter that is less than a first diameter; and a tip attached to the body at the first end.

In accordance with embodiments, a toy projectile system can include a toy projectile comprising a body having first and second ends and a nub extending outwardly from the second end, the nub being sized to interact with an improvised projectile checking housing assembly of a toy projectile launching apparatus; and the toy projectile launch apparatus with improvised projectile checking and locking features. The apparatus can include a projectile retaining element; a projectile barrel assembly extending rearward the projectile retaining element with the improvised projectile checking housing assembly of the projectile barrel assembly movable between checking and non-checking positions, the projectile barrel assembly comprising a step structure having a projectile receiving opening at the improvised projectile checking housing assembly thereof for allowing the toy projectile the nub present at the projectile receiving opening and preventing another projectile from the projectile receiving opening; an elongated structure in the improvised projectile checking housing assembly to check the nub; an improvised projectile button positioned at the end of the elongated structure; and an improvised projectile checking spring mounted to the improvised projectile button with the end of the elongated structure, the improvised projectile button of the elongated structure movable between checking and non-checking positions and preventing movement thereof unless the toy projectile having the nub is present at the projectile receiving opening of the improvised projectile checking housing assembly.

In accordance with embodiments, a toy projectile formed from an expanded beaded material is provided and has improved flight characteristics.

In embodiments, the toy projectile has improved accuracy, can be launched at higher velocity, and/or has improved precision.

In accordance with embodiments, a toy projectile has a body extending between a first end and an oppositely disposed second end, wherein at least a portion of the body is formed from an expanded beaded material, and a tip attached to the body at the first end.

In embodiments, the expanded beaded material is an expanded beaded polyolefin.

In embodiments, a ratio of the tip density to the body density is about 25:1 to about 50:1. In embodiments, the ratio of the tip density to the body density is about 30:1 to about 40:1, or about 35:1 to about 40:1. In embodiments, the ratio is about 37:1.

BRIEF DESCRIPTION OF THE DRAWING FIGURES

DETAILED DESCRIPTION

Figure 1:
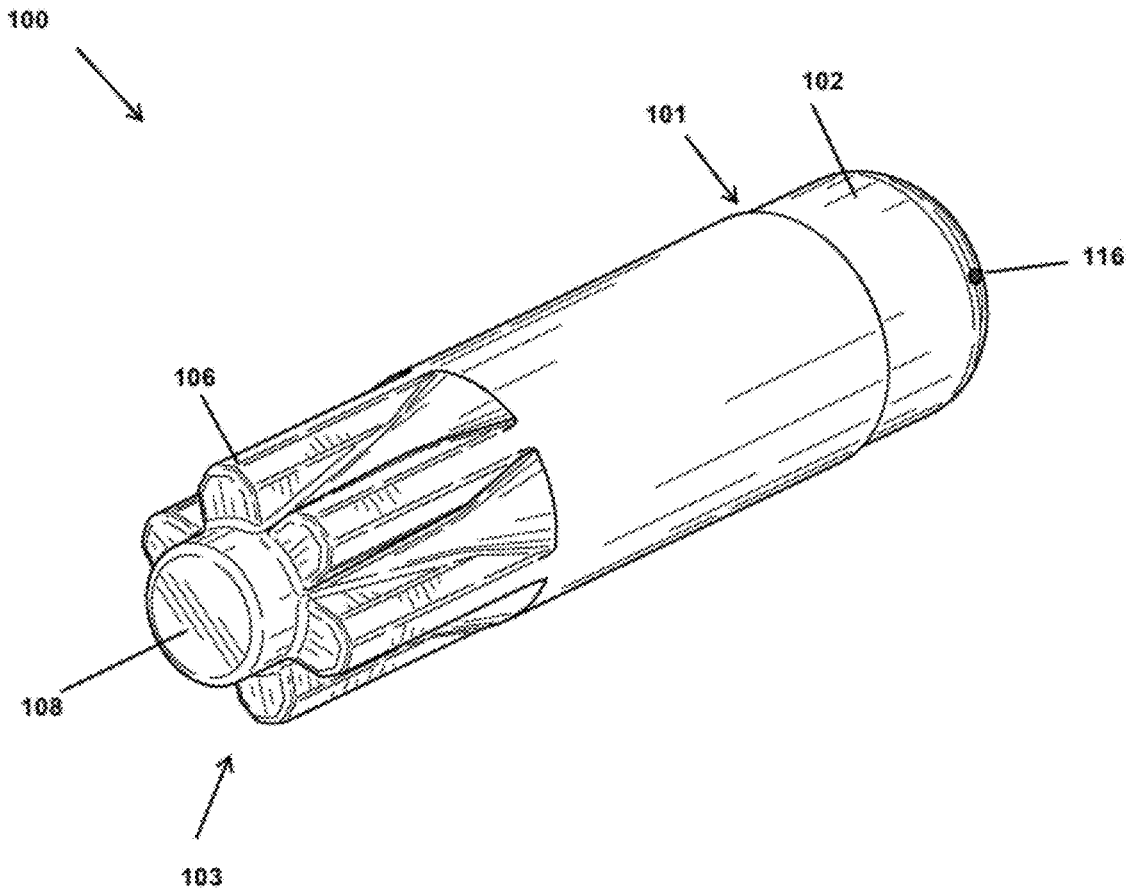
FIG. 1 is a perspective view of a schematic illustration of a toy projectile in accordance with embodiments of the disclosure.
Figure 2A:
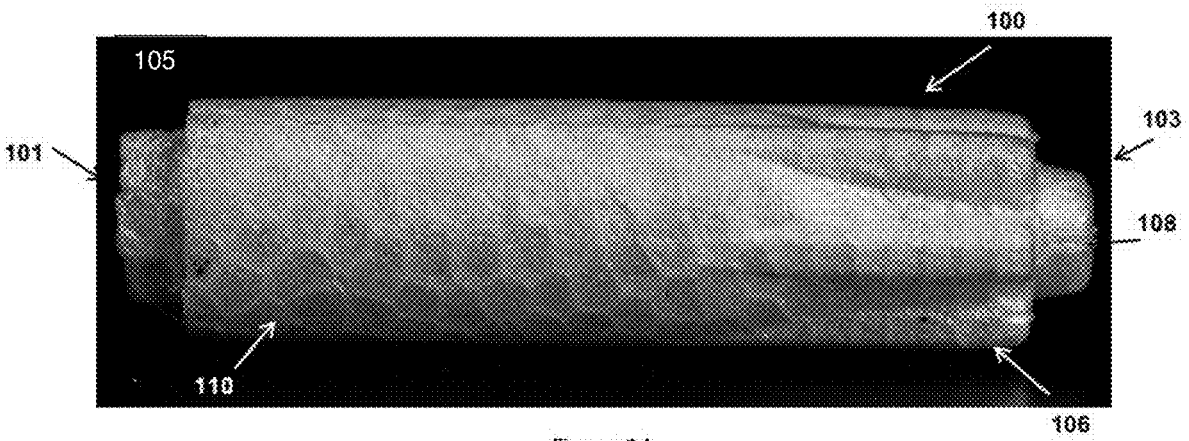
FIGS. 2A to 2D are photographs of a body of a toy projectile in accordance with embodiments of the disclosure showing a closed cell structure of the body made from an expanded beaded material.
Figure 2B:
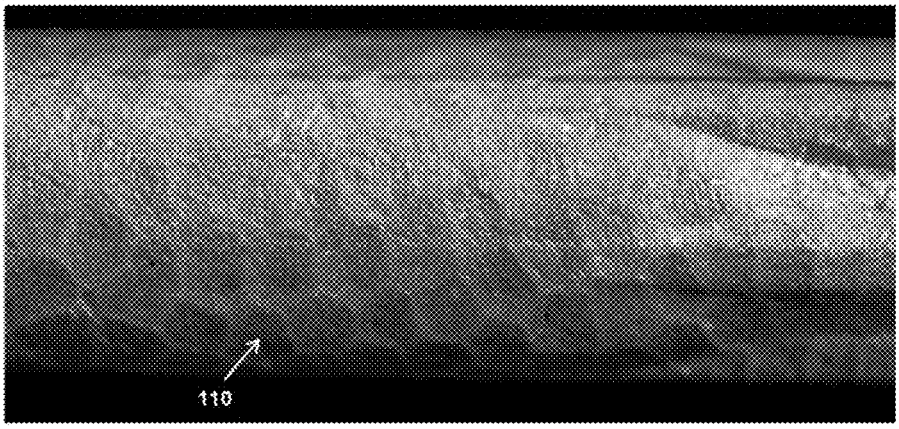
Figure 2C:
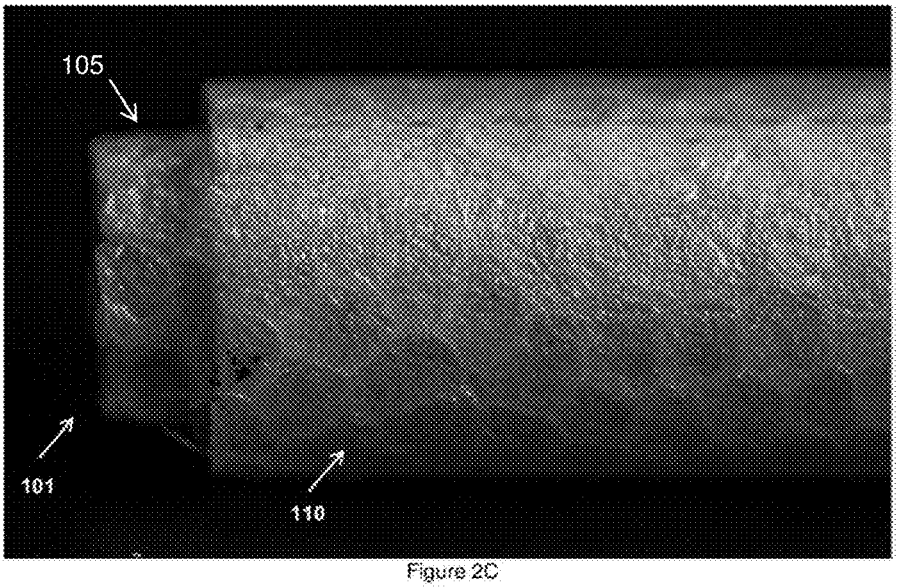
Figure 2D:
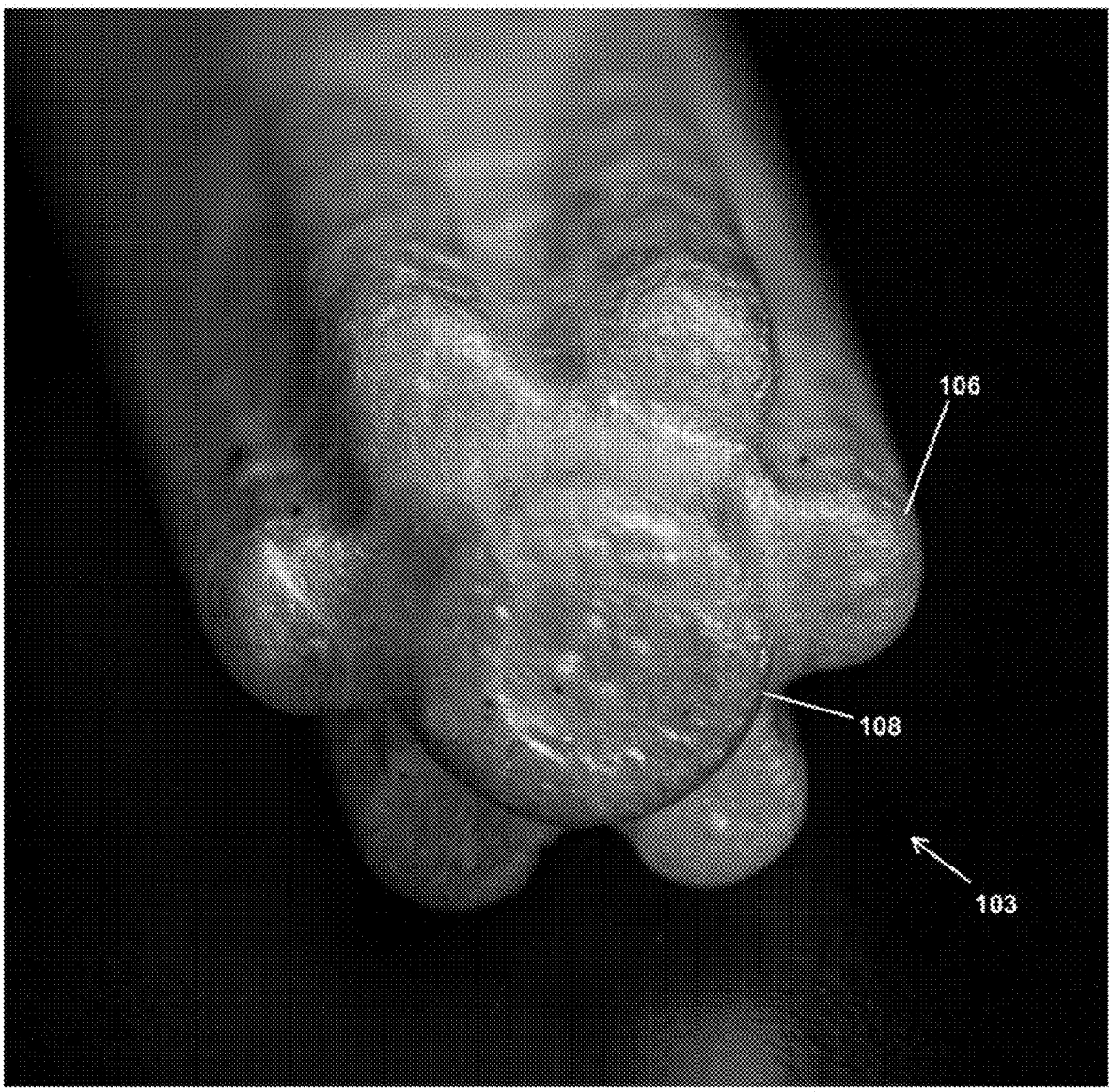

Referring to FIG. 1, a toy projectile 100 in accordance with embodiments generally includes a tip 102 attached to or disposed on a body 104. The tip 102 can be removable attached to or permanently attached to the body 104. The body 104 extends from a first end 101 to a second end 103. The tip 102 can be attached to the first end and the second end 103 can be a rear end. In various embodiments, as illustrated in FIG. 1, the toy projectile 100 can include further body structures such as one or more stepped fins 106 and a rearwardly projecting nub 108. In other embodiments, the body 104 can be a cylindrical or other shaped structure without such additional body structures. Suitable body shapes can include cylindrical, hexagonal, pentagonal, octagonal, or other faceted shape.

In accordance with embodiments, the body 104 that is made from an expanded beaded polyolefin materials. However, it is also contemplated herein that other non-beaded foam materials could be used.

Referring to FIGS. 2A-2D, the use of an expanded beaded material provides a body 104 that includes a plurality of closed cell structures 110. Each cell represents an expanded bead of material. Without intending to be bound by theory, it is believed that a closed-cell foam material can aid in improving accuracy and precision of the dart by improving rigidity through absorption and transfer of a rearward launch energy through the cellular structure during use as compared to, for example, open cell materials. In embodiments, the projectile can have a closed cell foam material optionally with further surface treatments to further enhance the flight characteristics such as reduced drag.

Expanded beaded materials can be shaped into the desired projectile configuration using known methods, including molding methods. The projectile can be a dart, an arrow, a ball, a disc, or any other known projectile configuration. In accordance with embodiments, the expanded beaded material can be an expanded beaded polyolefin, and/or expanded beaded thermoplastic polyolefins. For example, the expanded beaded material can be an expanded beaded polypropylene, expanded beaded polyethylene, expanded beaded polystyrenes, expanded beaded thermoplastic polyurethane, expanded beaded polylactic acid, and combinations thereof. In embodiments, the beaded material to be expanded can be solid or hollow or a combination of solid and hollow beads can be used. In embodiments, the body 104 includes expanded beads expanded an average amount of their original size by about 25× to 45×, about 30× to about 35×, about 35× to about 45×, or about 20× to about 30×. Other suitable average expansion amounts include about 20, 21, 22, 23, 24, 25, 26, 27, 28, 29, 30, 31, 32, 33, 34, 35, 36, 37, 38, 39, 40, 41, 42, 43, 44, or 45 times their original size. Other suitable expansion amounts can be determined as known in the art for a given specific expanded material.

Figure 10A:
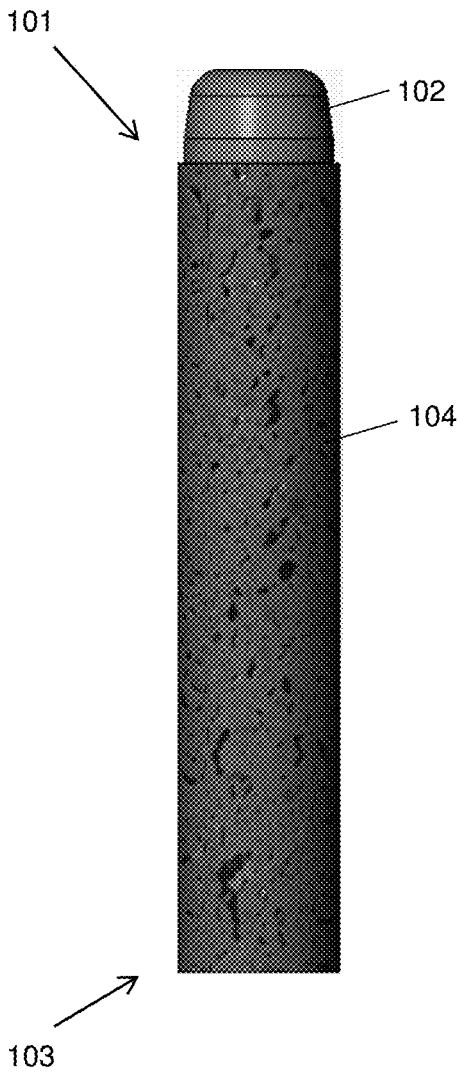
FIG. 10A is a front view of a toy projectile in accordance with embodiments of the disclosure.
Figure 10B:
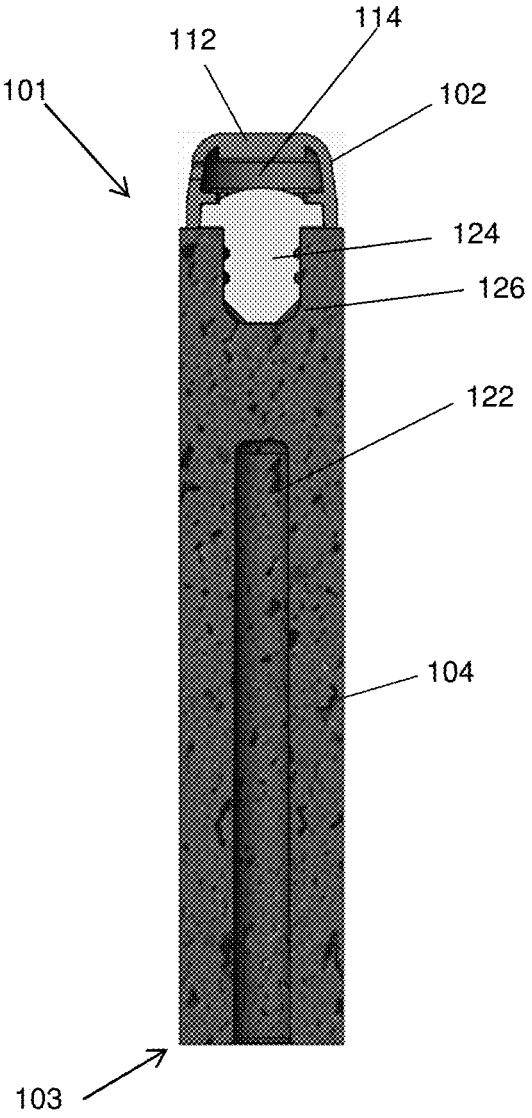
FIG. 10B is a cross-sectional view of the toy projectile of FIG. 10A.
Figure 11A:
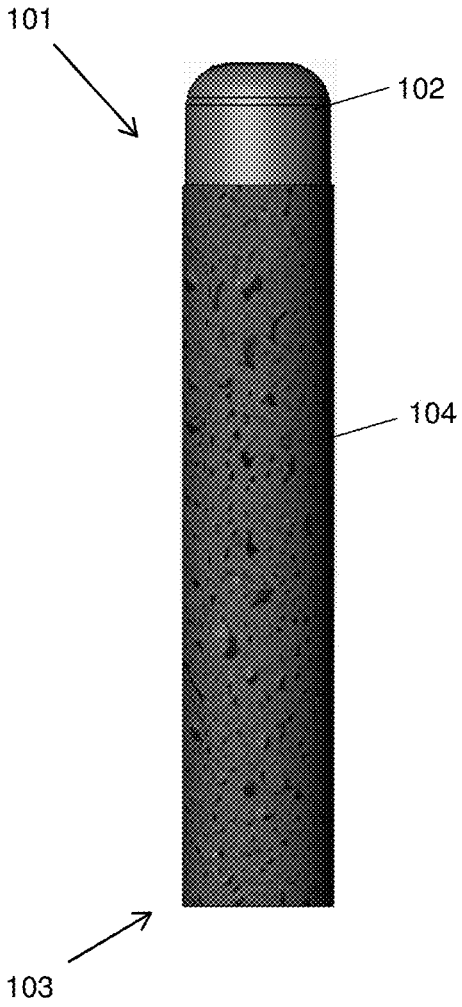
FIG. 11A is a front view of a toy projectile in accordance with embodiments of the disclosure.
Figure 11B:
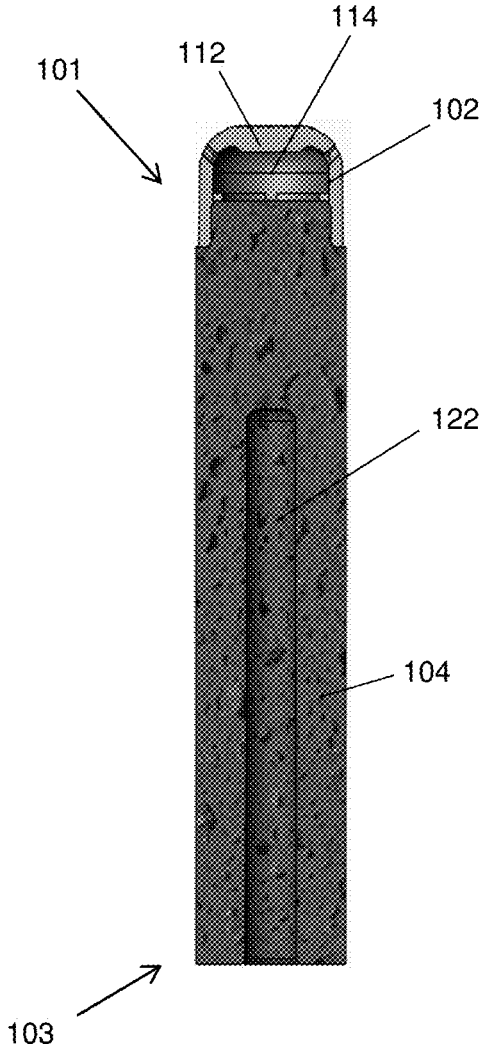
FIG. 11B is a cross-sectional view of the toy projectile of FIG. 11A.
Figure 12A:
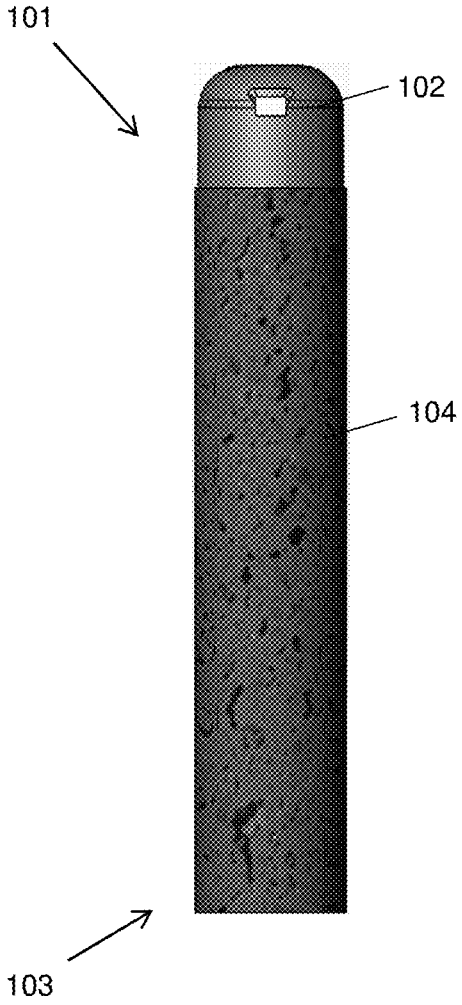
FIG. 12A is a front view of a toy projectile in accordance with embodiments of the disclosure.
Figure 12B:
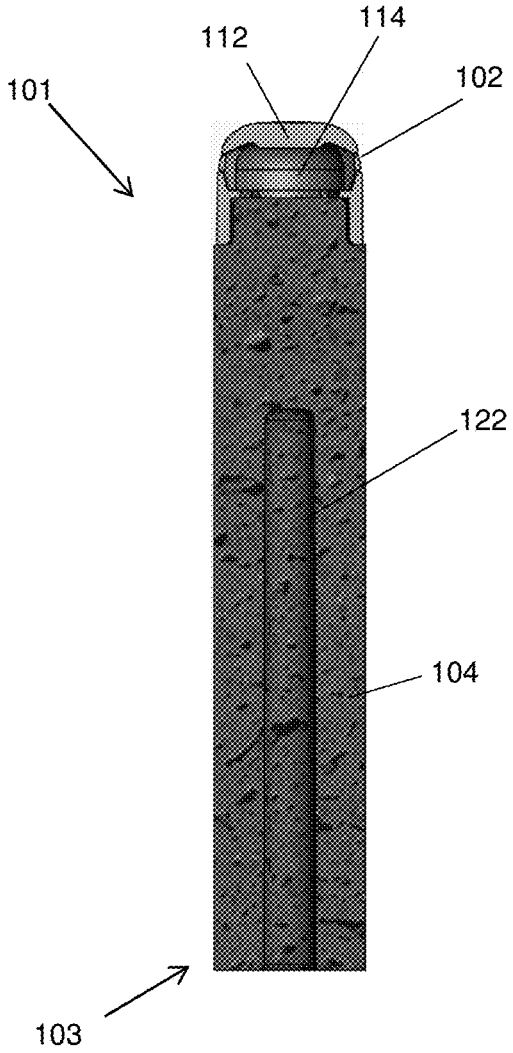
FIG. 12B is a cross-sectional view of the toy projectile of FIG. 12A.
Figure 13A:
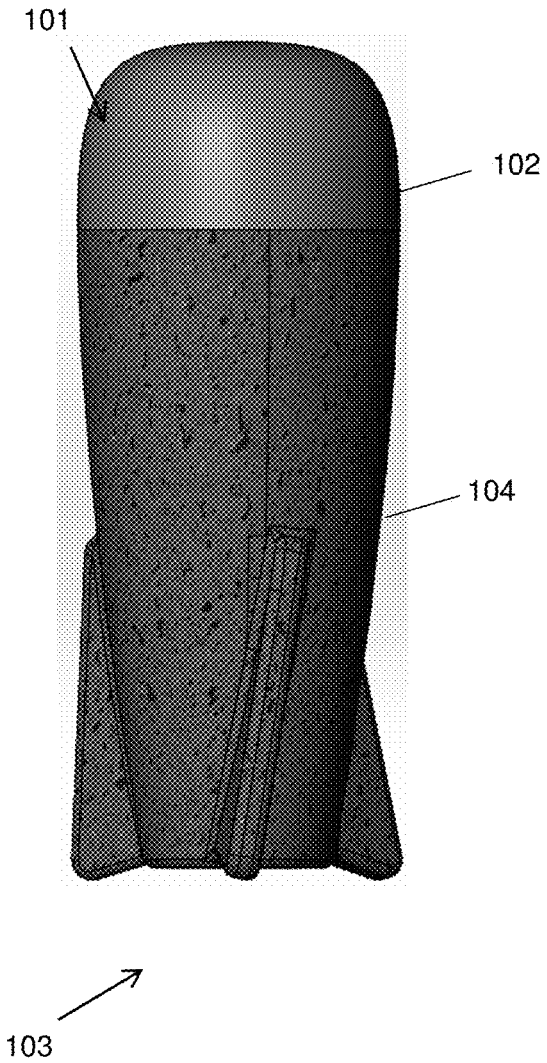
FIG. 13A is a front view of a toy projectile in accordance with embodiments of the disclosure.
Figure 13B:
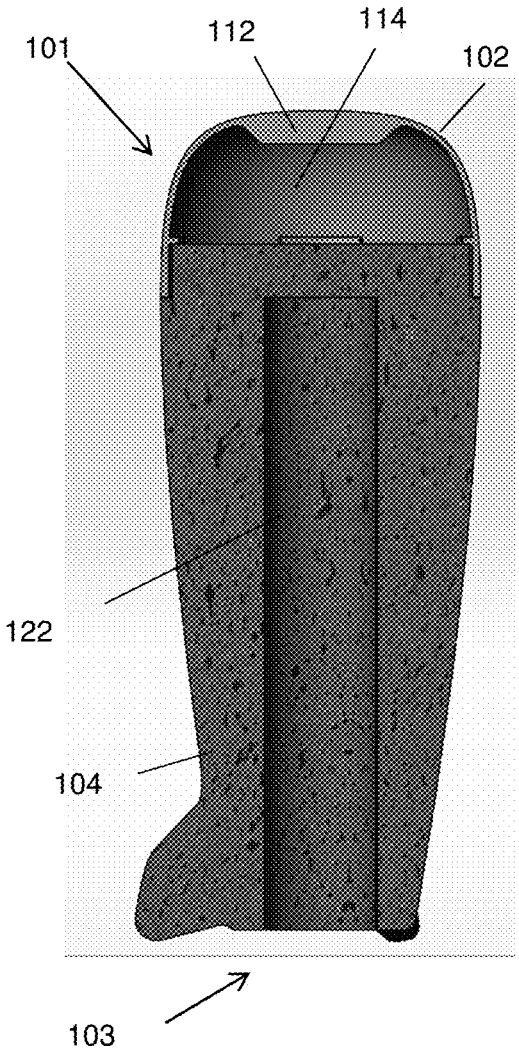
FIG. 13B is a cross-sectional view of the toy projectile of FIG. 13A.
Figure 14A:
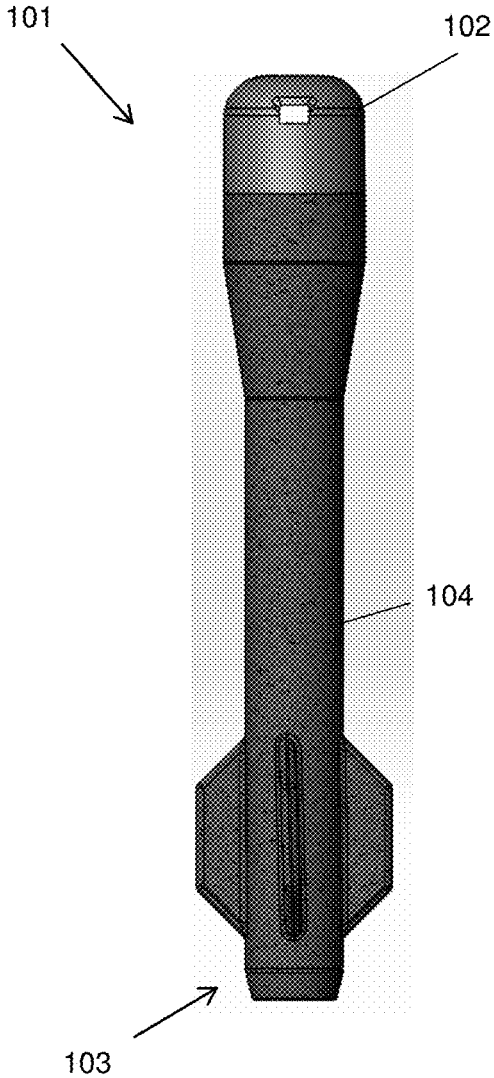
FIG. 14A is a front view of a toy projectile in accordance with embodiments of the disclosure.
Figure 14B:
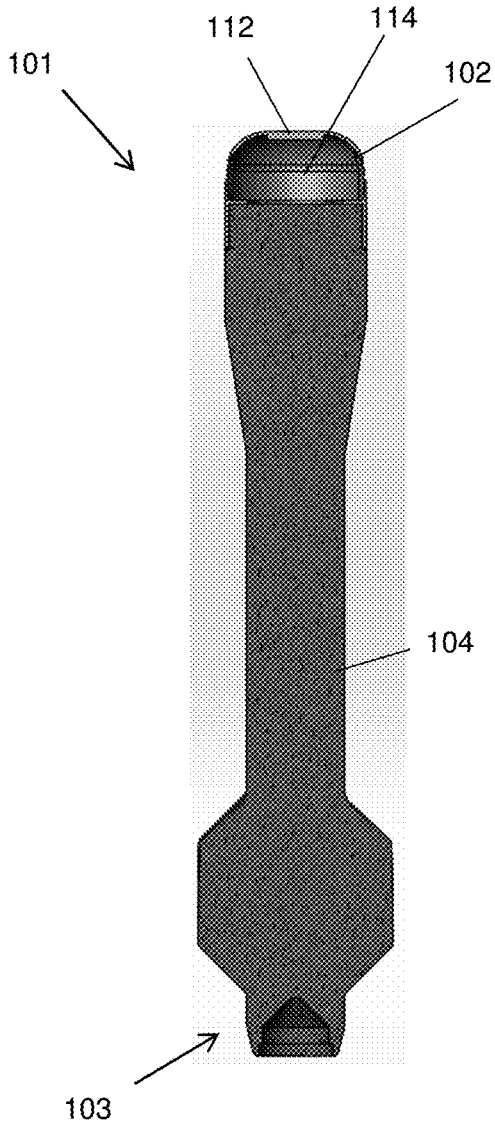
FIG. 14B is a cross-sectional view of the toy projectile of FIG. 14A.

In various embodiments, the body 104 can be provided as a solid structure of expanded beaded material. It has been advantageously found that due to the reduction in overall mass provided by the expanded beaded material, solid structures can be provided as opposed to conventional hollow structures. However, it is also contemplated herein that the body can be a hollow structure formed from an expanded beaded material. In embodiments in which the body includes or is a hollow expanded beaded material, it has been found that it can be advantageous to select a thickness of the wall of the hollow body to be at least 2 bead width thick to ensure sufficient structural rigidity and adhesion between beads during the molding process to avoid breakage during use and particularly repeated use. FIG. 10B illustrates an embodiment of a body 104 having a hollow portion defined by an opening 122 that extends partially through the length of the body 104. The length of the opening 122 can be varied for various toy projectile configurations and/or to accommodate various firing mechanisms. FIG. 13B, for example, illustrates an embodiment in which the opening 122 extends substantially the length of the body 104. In various embodiments, the width and length of the opening 122 can be used to adjust weight and density characteristics of the body 104.

Figure 4:
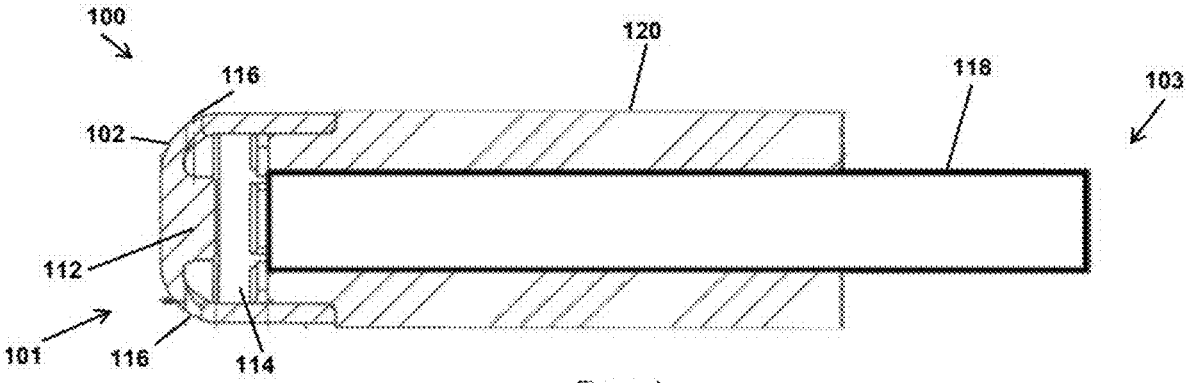
FIG. 4 is a cross-sectional view of a toy projectile having an inserted solid core in accordance with embodiments of the disclosure.
Figure 5:
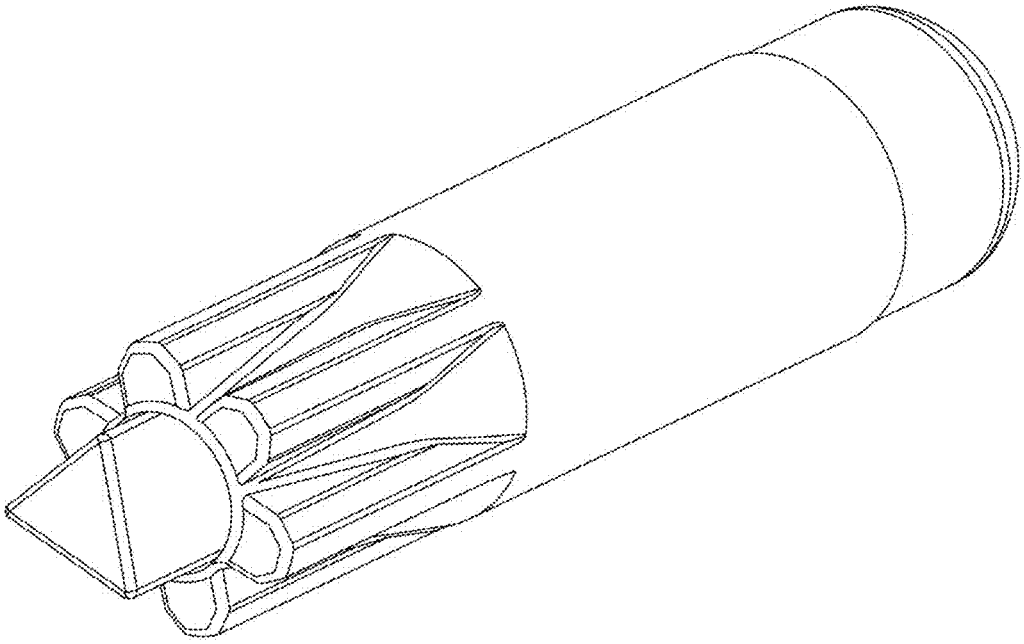
FIG. 5 is a perspective view of a schematic illustration of a toy projectile in accordance with embodiments of the disclosure, showing a triangular nub.
Figure 6:
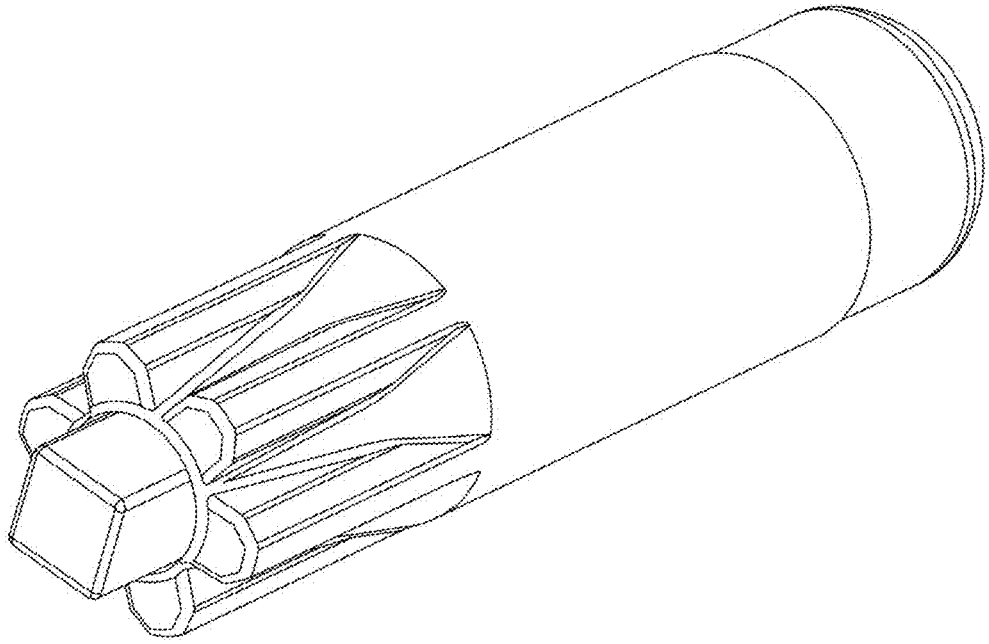
FIG. 6 is a perspective view of a schematic illustration of a toy projectile in accordance with embodiments of the disclosure, showing a rectangular nub.
Figure 7:
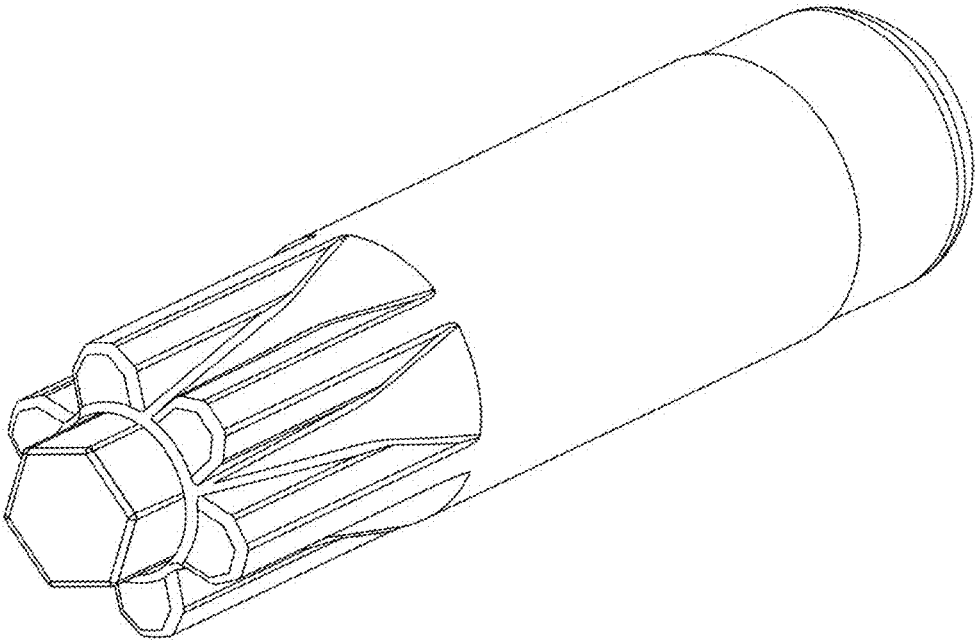
FIG. 7 is a perspective view of a schematic illustration of a toy projectile in accordance with embodiments of the disclosure, showing a hexagonal nub.
Figure 8:
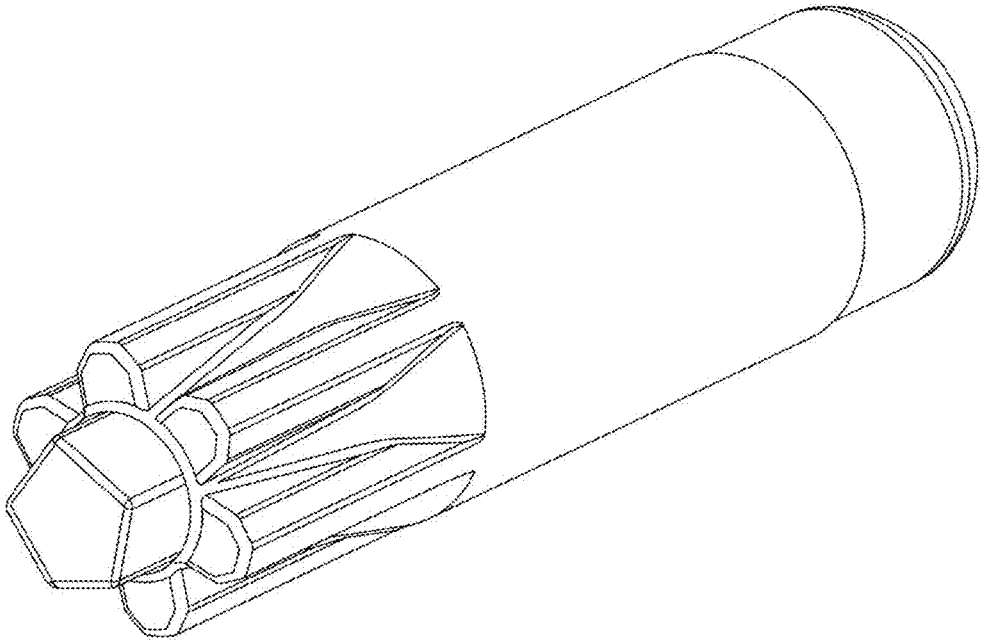
FIG. 8 is a perspective view of a schematic illustration of a toy projectile in accordance with embodiments of the disclosure, showing a pentagonal nub.
Figure 9:
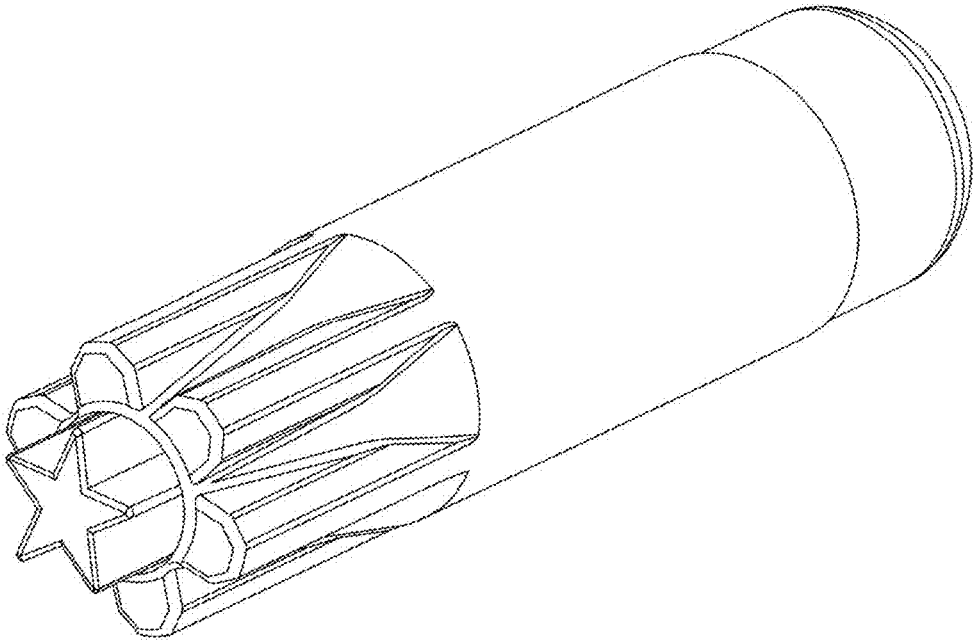
FIG. 9 is a perspective view of a schematic illustration of a toy projectile in accordance with embodiments of the disclosure, showing a star-shaped nub.

Alternatively, it is also contemplated as shown in FIG. 4, that the body can include a hollow portion and solid core 118 inserted into the hollow portion 120. In embodiments, one or both of the solid core and the hollow portion can be made from an expanded beaded foam material. In embodiments, such as illustrated in FIG. 4, the solid core 118 can extend outwardly from the hollow portion 120 of the body, such that the hollow portion 120 surrounds a portion of the solid core 118. The overall length of the extension can be varied depending on the overall desired length of the projectile 100, and needed compatibility with the particular launching apparatus with which the projectile 100 is to be used.

In embodiments in which the body 104 includes a core inserted into and surrounded by a hollow portion, the density or mass of the body is to be understood herein as the combined density or mass of the solid core 118 and the hollow portion 120—that is the entire body structure whether provided as separate or unitary pieces.

The body 104 can have a variety of shapes as shown in FIGS. 10-13. The shape of the body 104 can be tailored for the desired use. For example, toy projectiles can be shaped for insertion into a particular launch apparatus and/or play pattern.

As compared to conventional extruded materials used for toy projectile formation, formation of the projectiles in accordance with embodiments using expansion of beads of material in mold cavity can allow a variety of the shapes and features to be included on the projectiles that can be produced, particularly when producing a unitary structure. Additional elements such as fin structures and other potentially flight enhancing structures can be incorporated into a mold used for making the projectile from the expanded material. Expansion of the beads within the mold can allow for formation of additional body structures while maintaining adherence to the main body structure to prevent these additional structures from being broken, torn, separated from the body, or otherwise damaged during use. In various embodiments, the mold can have a polished interior surface, which can translate to a smooth surface finish on the molded product. In various embodiments, the smoothness achieved through molding can be sufficient. In other embodiments, surface coatings as are known in the art can be added if desired.

In various embodiments, projectile 100 can have a mass including the body and the tip of about 0.5 g to about 3 g, about 1.3 g to about 1.4 g, about 1 g to about 1.5 g, or about 1 g to about 2 g. Other suitable masses include about 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, and 30 g.

In various embodiments, the body 104 made from an expanded beaded material can have a density of about 20 $kg/m^3$ to about 30 $kg/m^3$, about 26 $kg/m^3$ to about 28 $kg/m^3$, about 22 $kg/m^3$ to about 30 $kg/m^3$, or about 24 $kg/m^3$ to about 29 $kg/m^3$. Other suitable densities include about 20, 21, 22, 23, 24, 25, 26, 27, 28, 29, and 30 $kg/m^2$. In embodiments, the density is 27.7 $kg/m^3$. The reduced density of the toy projectile 100 can allow, in various embodiments, the projectile 100 to be launched at higher rates of speed while maintaining safe use as a toy, as evaluated by ASTM F963-16 (2016). The standard incorporates a maximum value of the kinetic energy density requirement, which is calculated by the following equation:

$$KED = \frac{\frac{1}{2}\text{mass} * velocity^2}{\text{impact area}}$$

Reduction of the mass of the toy projectile aids in overall reduction of the KED, which in turn allows the projectiles to travel at higher velocity while maintaining acceptable KED for toy safety. In various embodiments, high velocity can correlate to increased flight distances.

It has been found, however, that simply reducing the overall mass of the projectile, while allowing increased velocity within a given range of KED does not necessarily result in a projectile with desired flight characteristics, such as stability of flight path, accuracy of striking an intended target, and repeatability of accuracy (precision). In fact, based on a reduction of mass alone, one might expect reduced flight properties, as the projectile may be more susceptible to external forces during flight and/or instability upon exiting a launcher.

Figure 3:
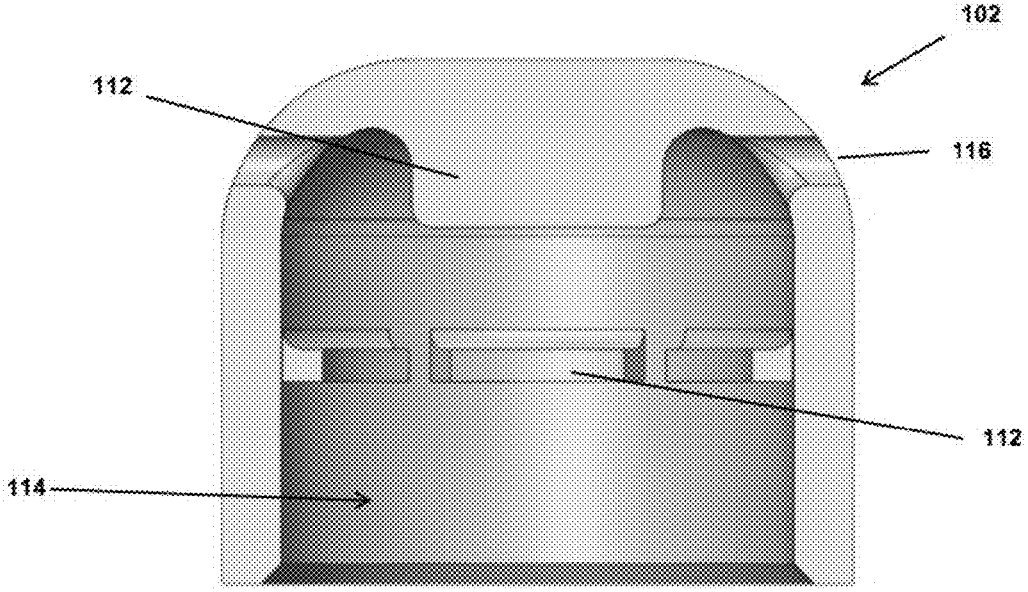
FIG. 3 is a cross-sectional view of a tip of a toy projectile in accordance with embodiments of the disclosure.

Referring to FIG. 3, in embodiments, the tip 102 can include an internal projection 112 that is designed to centrally add mass and raises the center of gravity of the tip 102. In various embodiments, the tip 102 can further include additional internal projections 112 on the internal side walls. In embodiments, these projections can enable attachment of tip 102 to dart body with an adhesive, for example. It has been advantageously found that the inclusion of an internal projection to increase mass of the tip results in positioning of the center of gravity of the projectile closer to the tip 102, given the lightweight nature of the body 104. This in turn provides a significant distance between the center of gravity of the projectile 100 and the center pressure of the projectile. In embodiments, the center of pressure is near the midpoint of the projectile. Without intending to be bound by theory, it is also believed that using a beaded foam material having a closed cellular structure can improve rigidity of the dart and stabilize the movement of the dart inside of a barrel of a launch apparatus, and flight path of the dart as it exits the launcher. Further, it is believed that the cellular structure does not absorb the launch energy and does not deform under such force and instead converts the launch energy to acceleration energy of the projectile. These benefits of improved rigidity and/or reduction of internal absorption of the launch energy to avoid deformation can result in improved precision.

It has been advantageously found that desired flight characteristics such as accuracy and/or precision, can be achieved in various embodiments by balancing a density of the body against the density of the tip 102 and having an increase mass in the tip. In embodiments, the ratio of the tip 102 density to the body 104 density can be about 25:1 to about 50:1. In embodiments, the ratio of the tip density to the body density can be about 30:1 to about 40:1, about 25:1 to 30:1, about 35:1 to 38:1 or about 35:1 to about 40:1. In embodiments, the ratio is about 37:1.

In embodiments, the density of the body 104 can have an increased density at the second end 103 as compared to the first end 101. In embodiments, the body 104 can have a gradient density increasing from the first end 101 to the second end 102. Differences and/or gradients of density can be provided by any variety of means, including but not limited to during a molding process or by addition of structures or other materials at or near the second end 102 after molding.

As further seen in FIG. 3, the tip can also include an internal chamber into which these projections extend. The internal chamber 114 is vented by one or more vent holes 116 disposed in the tip 102. The vent holes 116 can be positioned variously on the tip 102 so long as they are in fluid communication with the internal chamber 114. The vent holes 116 allow air from within the internal chamber 114 to escape upon impact of the tip against a surface, to thereby allow the outer walls of the tip 102 to expand outwardly such that the tip 102 impact area expands upon contact. This allows for increased impact area, which can further aid in keeping a KED within toy safety standard, while allowing the projectile to be launched with increase velocity.

Figure 15A:
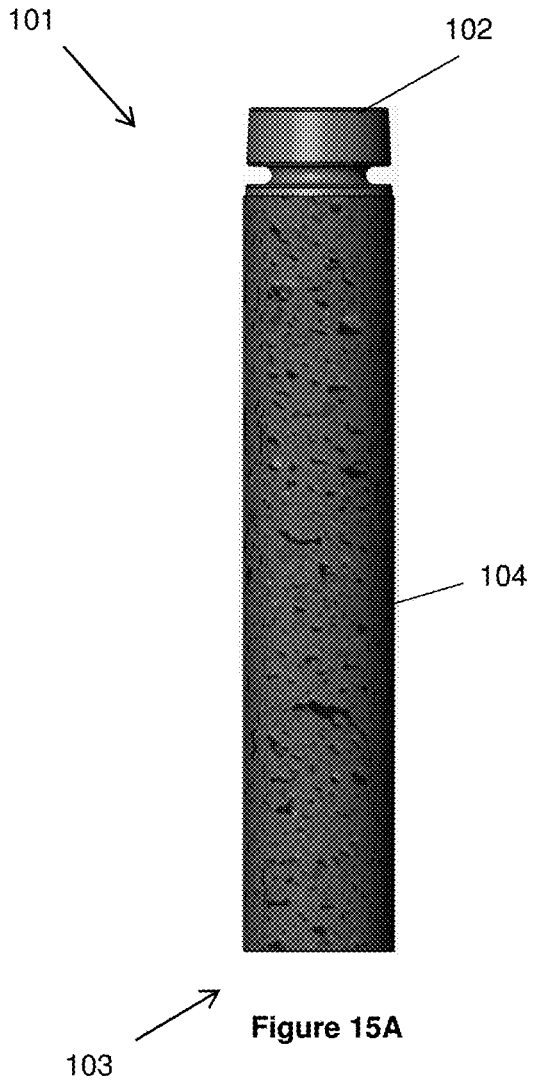
FIG. 15A is a front view of a toy projectile in accordance with embodiments of the disclosure.
Figure 15B:
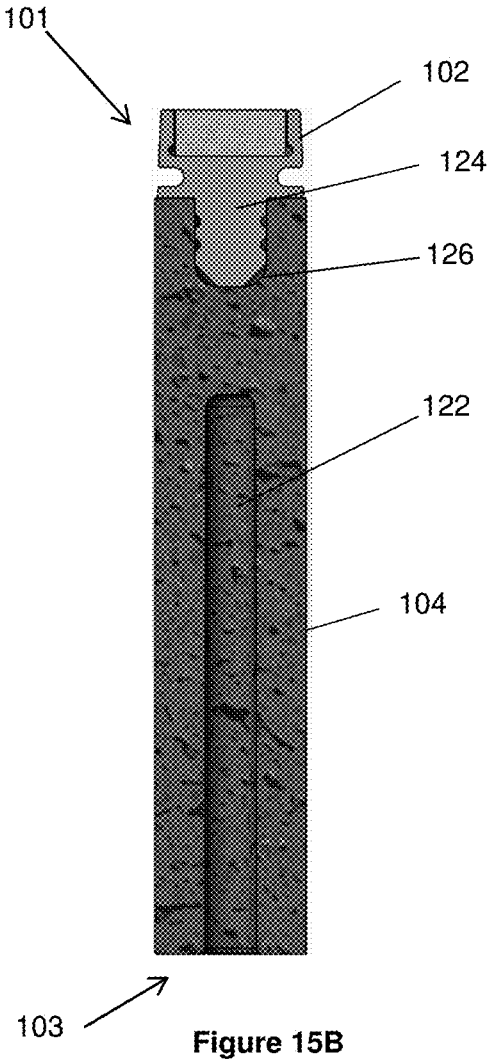
FIG. 15B is a cross-sectional view of the toy projectile of FIG. 15A.
Figure 16A:
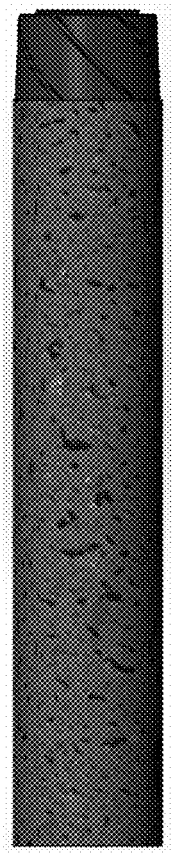
FIG. 16A is a front view of a toy projectile in accordance with embodiments of the disclosure.
Figure 16B:
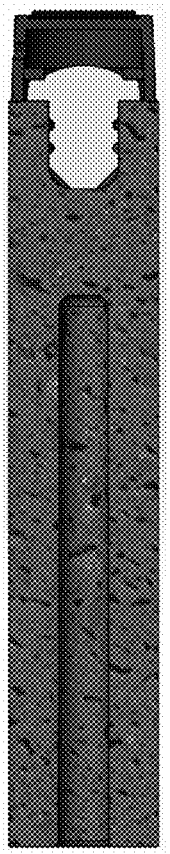
FIG. 16B is a cross-sectional view of the toy projectile of FIG. 16A.

In embodiments, increased tip-end mass can also be achieved with an insert 124 as illustrated in FIGS. 15B and 16B. Referring to FIG. 15B, the insert 124 can be an integral part of the tip 102 or, as illustrated in FIG. 16B, the insert 124 can be attached to a surface of the tip 102. Alternatively, the insert 124 can be a separate structure that can have one end that extends into the inner chamber 114 of the tip 102 and an oppositely disposed end that extends into an insert receiving opening 126 at the first end 101 of the body 104. In embodiments including an opening 122 extending from the second end 103, the opening 122 and the insert receiving opening 126 do not connect. That is, there remains some solid portion 128 of the body 104 disposed between the two openings 122, 126.

In various embodiments, the tip 102 is formed of a flexible material that allows the tip to expand significantly upon impact, thereby providing a large impact area over which the force of impact is distributed. In embodiments, the tip is formed from a rubbery material having a Shore A hardness of about 20 to about 50, about 30 to about 40, about 25 to about 35, or about 35 to about 50. Other suitable Shore A hardness values include about 20, 25, 30, 35, 40, 45, and 50. In embodiments, the tip is made from a thermoplastic rubber (TPR).

In various embodiments, the tip 102 can have an impact area of about 250 $m^2$ to about 400 $m^2$, about 275 $m^2$ to about 325 $m^2$, about 290 $m^2$ to about 310 $m^2$. Other suitable values include about 250, 260, 270, 280, 290, 300, 310, 320, 330, 340, 350, 360, 370, 380, 390, and 400 $m^2$.

Referring to again to FIG. 1, in embodiments, the toy projectile can include rearward stepped fins and nub portions as part of the body. In other embodiments, the toy projectile can include a rearward stepped portion and nub, with no fins. In yet further embodiments, the toy projectile can be free of a stepped portion and include a taper from a width of the body to the width of the nub.

The toy projectile can have any suitable size. For example, the toy projectile can have an overall length of about 50 mm to about 100 mm, about 60 mm to about 80 mm, or about 75 mm to about 80 mm. Other suitable lengths include about 50, 52, 54, 56, 58, 60, 62, 64, 66, 68, 70, 72, 74, 76, 78, 80, 81, 82, 83, 84, 85, 86, 87, 88, 89, or 100 mm. For example, the toy projectile can have an overall length of about 61 mm. For example, the toy projectile can have an overall length of about 62 mm. For example, the toy projectile can have a length of about 69 mm.

In embodiments, the toy projectile can have a body that has a length as defined between the first and second ends of about 40 mm to about 65 mm, about 45 mm to about 55 mm, about 50 mm to about 60 mm. Other suitable body lengths include about 40, 41, 42, 43, 44, 45, 46, 47, 48, 49, 50, 51, 52, 53, 54, 55, 56, 57, 58, 59, 60, 61, 62, 63, 64, or 65 mm.

Figure 17A:
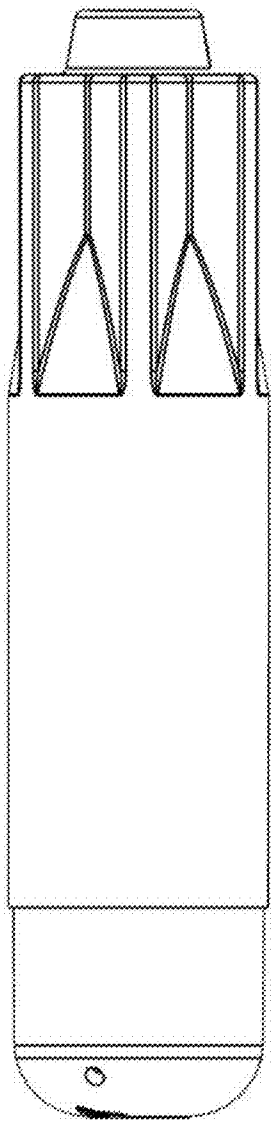
FIG. 17A is a side view of a toy projectile in accordance with an embodiment of the disclosure.

In embodiments, the body can have a cylindrical shape. In embodiments, the body can include a reduced diameter portion 105 at the first end 101 for over which the tip 102 can be disposed and attached to the body. Reference herein to a diameter of the body is made to the general and overall diameter of the body, which can be measured at a central portion of the body. The reduced diameter portion has a diameter reduced with respect to the overall diameter of the body. For example, the overall diameter (or diameter at a central portion of the body) can be about 10. For example, the overall diameter can be the diameter of the body measured at a point at which the diameter is at its maximum. In embodiments, as illustrated in FIG. 17A, for example, the fins extending from the body can be arranged on a tapered diameter portion of the body such that the outer circumference of the fins has the same or substantially the same diameter as the overall diameter of the body (not including a reduced tip portions). For example, the body having the taper can have a boat tail structure. In such embodiments, when considering the circumference defined by the outrebounds of the fins, the body has a substantially uniform diameter except optionally for a reduced diameter portion at the first end to accommodate the tip. The nub portion, which can be a terminal end of the boat tail structure of the body or a separate or other integrally formed structure can have a reduced diameter as compared to the body diameter, as described herein.

For example, the body can have a diameter of about 10 mm to about 20 mm, about 14 mm to about 18 mm, about 15 mm to about 17 mm, or about 16 mm. Other suitable diameters may include about 10, 10.5, 11, 11.5, 12, 12.5, 13, 13.5, 14, 14.5, 15, 15.5, 16, 16.5, 17, 17.5, 18, 18.5, 19, 19.5, or 20 mm. The diameter can be measured as a maximum diameter of the body. In embodiments, the diameter of the body can remain substantially constant between at least a central portion of the body and the fin region when accounting for the circumferential dimension defined by the outer surfaces of the fins.

The body can include a nub portion extending from the second end. The nub portion can have a length extending between a first nub end and a second nub end. The first nub end can be continuous with the second end of the body. In embodiments, the body can have a boat tail structure at the second end that tapers and terminates in the nub portion having a reduced diameter as compared to the diameter of the body upstream of the boat tail structure. In such embodiments, the nub portion may not be considered as having a defined second nub end, but rather is provided as a continuous extension of the body. Also in such embodiments, the body having the boat tail structure can have a second end which is the terminal end of the projectile and thus is positioned at the end of the nub portion. The body, thus, has a reduced diameter portion, which defines the nub portion, as a tapered reduction from a point adjacent to the second end to the second end. As described in the paragraph above, the body can also have in such embodiments a reduced diameter portion at the first end for accommodating the tip. The diameter of the body in such boat tail embodiments is considered as measured at a position of the body in which the diameter is at a maximum, not including any extensions from the body such as fins, and the diameter of the nub is considered to be the diameter at the second end.

In embodiments, the body can have a substantially cylindrical shape with fins disposed at the second end and a nub portion 108 extending from the second end. The fins can be spaced uniformly around the circumference of the body and the portion of the body disposed in the space between fins can be tapered inwardly along a length of the fins towards the nub portion. That is, the portion of the body in the spacing can taper from a first diameter corresponding to the diameter of the body upstream of the fins to a second, reduced diameter corresponding to a diameter of the nub portion 108. Such taper can give the projectile the appearance of a boat tail structure at the second end, which terminates at the nub portion, and with the fins extending outwardly from the boat tail structure upstream of the nub portion. Without intending to be bound by theory, it is believed that the combination of the boat tail structure with the fins can result in improved flight characteristics, including but not limited to flight distance and flight stability.

The nub portion, for example, can be sized to interact with a housing structure of a toy projectile launch apparatus to ensure an appropriately sized projectile is being used with the given apparatus. Referring to FIGS. 5-9, the nub portion can have any suitable size and shape so long as it is of sufficient diameter to fit within the housing structure. In embodiments, the nub portion has a minimum length corresponding to a length of the housing structure through which the nub portion must pass to engage with a locking or other interfacing structure of the apparatus. Shapes of the nub portion include, but are not limited to, circular, elliptical, star, hexagonal, triangular, and rectangular. In embodiments, the nub portion has side walls, which taper to connect with the base from which the nub portion extends. In other embodiments, the nub portion does not taper with respect to the base from which it extends. In embodiments, the side walls of the nub portion are entirely connected to and in contact with the base. In other embodiments, the nub portion connects to the base at a point or a line, such that there is at least one gap between the nub portion and the base.

In embodiments, the nub portion terminates at a second end and has a flat or substantially flat surface at the second end. For example, a substantially flat surface may have some rounding or doming or mold markings from the manufacturing process such as minor indentations or dimples, but otherwise visually appears to be generally planar. For example, the terminal surface can be free of gaps, openings, apertures, notches, or the like.

Figure 17B:
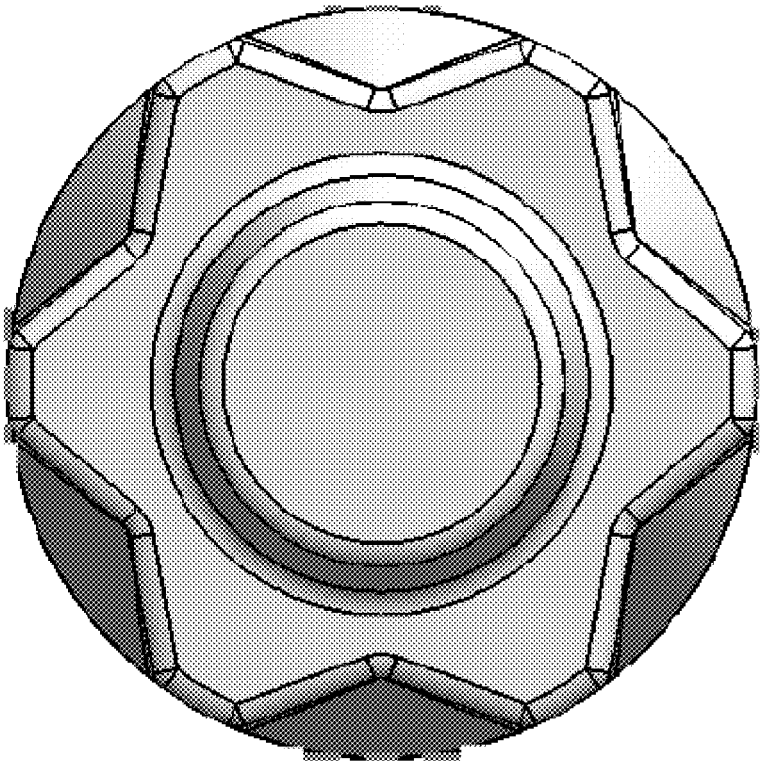
FIG. 17B is a rear view of the toy projectile of FIG. 17A.
Figure 17C:
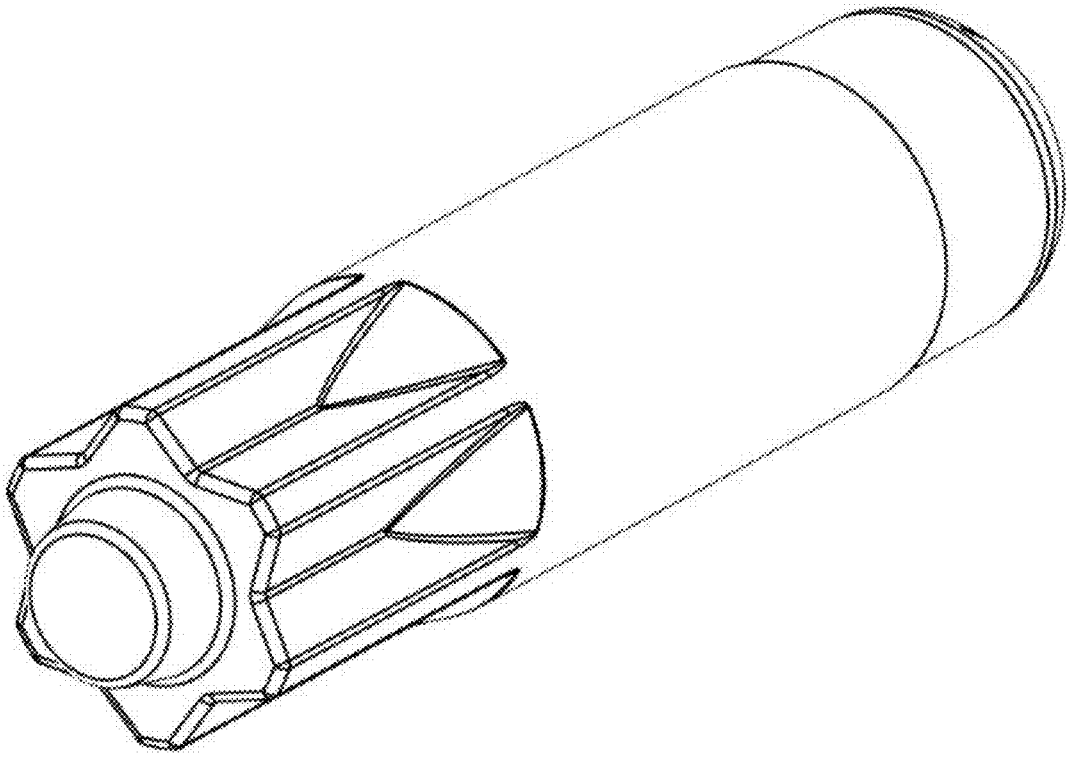
FIG. 17C is a perspective view of the toy projectile of FIG. 17A.
Figure 18A:
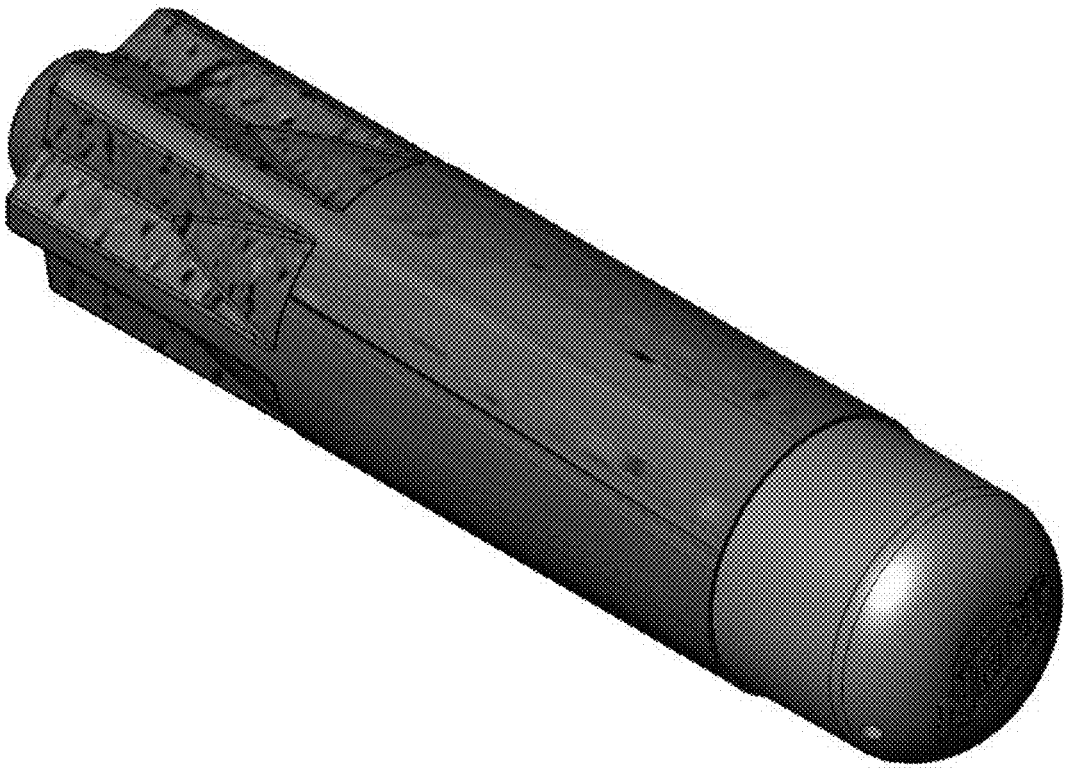
FIGS. 18A and 18B are perspective views of the toy projectile of FIG. 17A showing the surface texture resulting from forming the projectiles using an expanded beaded material.
Figure 18B:
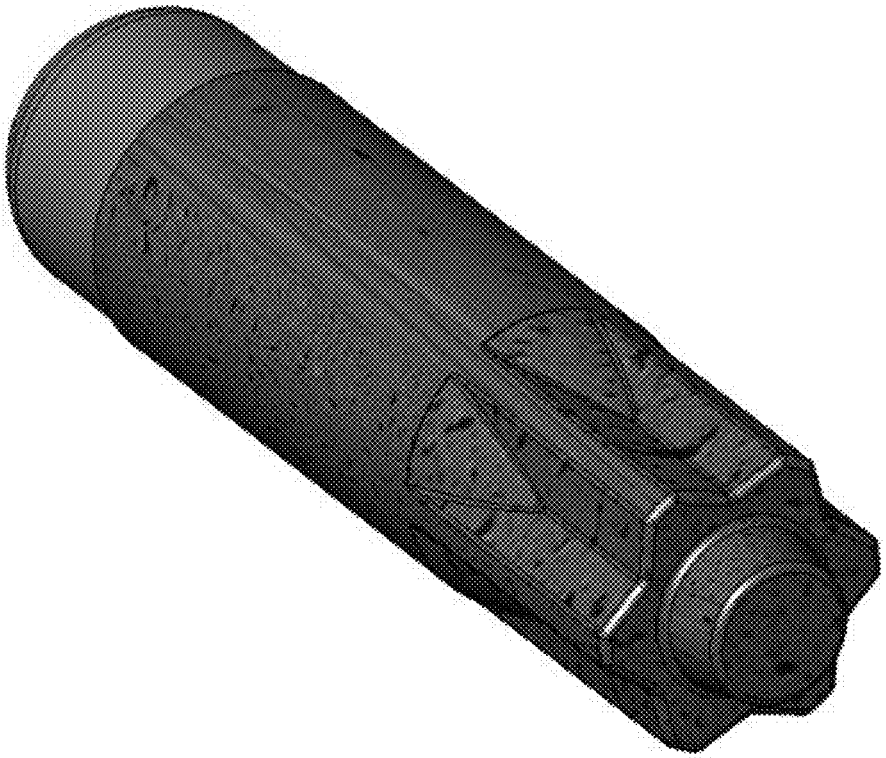

In embodiments, for a toy projectile such as shown in FIG. 17, the nub portion 108 can have a length as defined between the second end or a fin end and an oppositely disposed end of the nub of at least about 1 mm to at least about 5 mm, about 2 mm to about 4 mm, about 3 mm to about 3.5 mm. For example, the nub portion 108 can have a length of about 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3, 1.75, 3.2, 3.3, 3.4, 3.5, 3.6, 3.7, 3.8, 3.9, 4, 4.1, 4.2, 4.3, 4.4, 4.5, 4.6, 4.7, 4.8, 4.9, or 5 mm.

In embodiments, the ratio of the length of the body to the length of the nub can be about 12:1 to about 20:1, about 15:1 to about 18:1, about 17:1 to about 18:1, or about 15:1 to about 17:1. Other suitable ratios include, about 12:1, 13:1, 14:1, 15:1, 16:1, 17:1, 18:1, 19:1, and 20:1. For example, the ratio can be about 17.25:1. In an embodiment, the toy projectile can have a total length of about 60 mm to about 70 mm and the nub can have a length of about 3 mm to about 5 mm.

In embodiments, a length of the nub portion 108 may be irrelevant and longer lengths, for example of 10 mm or more, may be suitably used with toy projectile launchers having a IP detection system as detailed below so long as the nub portion 108 has a suitable diameter (or effective diameter) to fit within and engage with a locking or other interfacing structure of an IP detection system.

In embodiments for use with a toy projectile launcher such as shown in FIG. 17, the nub portion 108 may have a diameter of about 2 mm to about 8 mm, about 3 mm to about 7 mm, about 4 mm to about 8 mm, or about 5 mm to about 7 mm. Other suitable diameters include about 2, 2.1, 2.2, 2.3, 2.4, 2.5, 2.6, 2.7, 2.8, 2.9, 3, 3.1, 3, 1.75, 3.2, 3.3, 3.4, 3.5, 3.6, 3.7, 3.8, 3.9, 4, 4.1, 4.2, 4.3, 4.4, 4.5, 4.6, 4.7, 4.8, 4.9, 5.1, 5.2, 5.3, 5.4, 5.5, 5.6, 5.7, 5.8, 5.9, 6, 6.1, 6.2, 6.3, 6.4, 6.5, 6.6, 6.7, 6.8, 6.9, 7, 7.1, 7.2, 7.3, 7.4, 7.5, 7.6, 7.7, 7.8, 7.9, or 8 mm.

In embodiments, a toy projectile launcher having an IP detection system may identify a step between a second end of the projectile and the nub portion. The step can be defined by a difference in diameter between at the second end or fin end and the nub portion. In embodiments, the difference between the diameter at the second end or fin end and the diameter of the nub can be about 0.5 mm to about 3 mm, about 1 mm to about 2 mm, about 1 mm to about 3 mm, or about 0.7 mm to about 1.6 mm. Other suitable differences in diameter include about 0.5, 0.6, 0.7, 0.8, 0.9, 1, 1.1, 1.2, 1.3, 1.4, 1.5, 1.5875, 1.6, 1.7, 1.8, 1.9, 2, 2.1, 2.2, 2.3, 2.4, 2.5, 2.6, 2.7, 2.8, 2.9, 3.

In embodiments, a toy projectile in accordance with the disclosure can have a ratio of the diameter of the body (at a maximum width of the body) to the diameter of the nub portion of about 10:1 to about 1.25:1, about 5:1 to about 2.5:1, about 3:1 to about 2:1, about 10:1 to about 5:1. Other suitable amounts include about 10:1, 9.5:1, 9:1, 8.5:1, 8:1, 7.5:1, 7:1, 6.5:1, 6:1, 5.5:1, 5:1, 4.75:1, 4.5:1, 4.25:1, 4:1, 3.75:1, 3.5:1, 3.25:1, 3:1, 2.75:1, 2.5:1, 2.25:1, 2:1, 1.75:1, 1.5:1, or 1.25:1.

In embodiments, the body can include rearward fins. Any suitable number of fins can be included on the body. For example, the projectile can include 6 fins spaces to surround the circumference of the body. Other fin numbers are contemplated. The fins can be disposed at the second end and can terminate in a fin end from which the nub projection then extends to define a step between the fin end and the nub projection. The fins can also have various cross sectional shapes and can be for example rounded or faceted in various embodiments. Advantageously, using a molded expanded material, the fins can be made as a unitary piece with the body. In embodiments, however, it is also contemplated that the fins are attached to the body using and known methods, including heat sealing, adhesives, tapes, etc. Referring to FIG. 1, the rear fins can have a generally rounded shape or a half-cylindrical shape with the top of the fin having a rounded shape. Alternatively, referring to FIGS. 17A and 17B, the rear fin structures can have more linearly defined edges, with the top of the fin being flat.

In embodiments, the projectile 10 can include features to allow it to be used with launchers having an improvised projectile checking housing structure such as described in herein and the co-filed application entitled "Toy Launch Apparatus with Multiple Improvised Projectile Checking and Locking Methods." For example, the projectile 100 can include a stepped end and a nub 108, such that when the stepped end and nub are present at a projectile receiving opening with a corresponding step for allowing rearward stepped structure and nub portion of appropriate projectiles at the projectile receiving opening, such that detection checks are triggered.

In embodiments, a toy projectile system can include a toy projectile having a stepped and nub and a toy projectile launch apparatus having a projectile receiving opening and improvised projectile checking housing assembly that can identify the toy projectile as compatible for the blasters.

Aspects

Aspect 1. A projectile, comprising:

a body extending between a first end and an oppositely disposed second end, wherein at least a portion of the body is formed from an expanded beaded material;

a tip attached to the body at the first end, the tip comprising an internal projection extending into an internal cavity, and one or more vent holes in fluid communication with the internal chamber, wherein a ratio of a density of the body to a density of the tip is about 20:1 to about 40:1.

Aspect 2. A projectile, comprising:

a body extending between a first end and an oppositely disposed second end, wherein at least a portion of the body is formed from an expanded beaded material, the body having an insert receiving opening extending into the body from the first end and extending less than an entirety of a length of the body;

a tip attached to the body at the first end, the tip having an internal cavity; and an insert having a first end extending into the internal cavity and a second end extending into the insert receiving opening, wherein a ratio of a density of the body to a density of the tip is about 20:1 to about 40:1.

Aspect 3. A projectile, comprising:

a body extending between a first end and an oppositely disposed second end, wherein at least a portion of the body is formed from an expanded beaded material, the body having an insert receiving opening extending into the body from the first end and extending less than an entirety of a length of the body; and a tip having an insert projection, the insert projection extending into the insert receiving opening of the body, wherein a ratio of a density of the body to a density of the tip is about 20:1 to about 40:1.

Aspect 4. The projectile any one of the preceding aspects, wherein the expanded beaded material is one or more of expanded beaded polyethylene, expanded beaded polypropylene, expanded beaded polystyrene, expanded beaded thermoplastic polyurethane, and expanded beaded polylactic acid.

Aspect 5. The projectile of any one of the preceding aspects, wherein the body further comprises one or more fins disposed at or adjacent to the second end of the body.

Aspect 6. The projectile of aspect 5, wherein the body comprises 4 fins.

Aspect 7. The projectile of aspect 5, wherein the body comprises 6 fins.

Aspect 8. The projectile of any one of the preceding aspects, wherein the body further comprises a nub extending outwardly from the second end, wherein the nub has a diameter that is less than a diameter of the body at a second end.

Aspect 9. The projectile of aspect 8, wherein the nub extends about 4 mm from the second end.

Aspect 10. The projectile of aspect 8 or 9, wherein a step is disposed between the second end and the nub.

Aspect 11. The projectile of aspect 10, comprising a taper wall connecting the step and the nub.

Aspect 12. The projectile of aspect 11, wherein the taper is about 100°.

Aspect 13. The projectile of aspect 12, comprising a non-tapered wall connecting the step and the nub.

Aspect 14. The projectile of any one of the preceding aspects, wherein the body is solid.

Aspect 15. The projectile of any one of aspects 1 to 13, wherein the body comprises a hollow portion and a solid core disposed in the hollow portion, wherein the solid core is formed from the expanded beaded material.

Aspect 16. The projectile of any one of aspects 1 to 13, wherein the body comprises a hollow portion extending into the body from the second end to the first end, the hollow portion extending less than an entirety of the length of the body.

Aspect 17. A toy projectile, comprising:

a body having a length extending between a first end to an oppositely disposed a second end, wherein the body has a substantially cylindrical shape;

a nub portion extending from the second end, the nub portion having a diameter smaller than a diameter of the body at the second end, such that a step is defined between the second end and the nub portion, wherein the nub portion has a length extending between a first nub end and a second nub end, the first nub end is contiguous with the second body end, and the second nub end terminates in a flat or substantially flat surface;

a tip attached to the body at the first end; and one or more fins attached to or integrally formed with the body at the second end upstream the nub portion.

Aspect 18. The toy projectile of claim 17, wherein a ratio of the body length to the nub portion length is about 12:1 to about 20:1.

Aspect 19. A toy projectile, comprising a body extending from a first end to a second end, wherein the body has a boat tail structure, such that a diameter of the body tapers from a maximum body diameter towards the second end to define a nub portion having a nub diameter less than the maximum body diameter;

one or more fins disposed on the body adjacent the second end around a circumference of the body, wherein an outer circumference is defined by the outer surface of the one or more fins and a diameter of the outer circumference is substantially the same as the maximum body diameter;

wherein the one or more fins terminate at fin ends upstream the nub portion, such that the nub portion extends outwardly defining a reduced circumferential portion as compared to an outer circumference defined by the one or more fins and a step is defined between the fin ends and the nub portion.

Aspect 20. The toy projectile of claim 19, wherein a ratio of the maximum body diameter to the nub diameter is about 10:1 to about 1.25:1.

Aspect 21. The toy projectile of claim 19, wherein a difference between the maximum body diameter and the nub diameter is about 0.5 mm to about 3 mm.

Aspect 22. A toy projectile, comprising:

a body extending from a first end to a second end;

a plurality of fins attached to or integrally formed with the body at the second end, wherein the body including the fins has a first diameter, each fin being separated from adjacent fins by a space, wherein a portion of the body disposed in the space is tapered inwardly along a length of the fin towards the second end;

a nub portion extending from the second end, wherein nub portion has a second diameter that is less than the first diameter; and a tip attached to the body at the first end.

Aspect 23. The toy projectile of claim 22, wherein a ratio of the first diameter to the second diameter is about 10:1 to about 1.25:1.

Aspect 24. The toy projectile of claim 22, wherein a difference between the first diameter and the second diameter is about 0.5 mm to about 3 mm.

Aspect 25. The toy projectile of any one of the preceding claims, comprising 6 fins spaced to surround a circumference of the body.

Aspect 26. The toy projectile of any one of the preceding claims, wherein the nub portion has a length defined between the fin end and an oppositely disposed end of the nub portion of about 1 to 5 mm.

Aspect 27. The toy projectile of any one of the preceding claims, wherein the nub portion comprises a circumferential wall joining a first nub end at the second end and an oppositely disposed second nub end, wherein the circumferential wall tapers inwardly from the first nub end to the second nub end.

Aspect 28. The toy projectile of claim 27, wherein the circumferential wall has a taper of about 100°.

Aspect 29. The toy projectile of any one of the preceding claims, wherein the nub portion comprises a circumferential wall joining a first nub end at the second end and an oppositely disposed second nub end, wherein the circumferential wall is a straight non-tapered wall.

Aspect 30. The toy projectile of any one of the preceding claims, wherein the body has a length defined between the first and the second end of about 50 mm to about 100 mm.

Aspect 31. The toy projectile of any one of the preceding claims, wherein the body has a reduced diameter portion at the first end and the tip is sized to fit over the reduced diameter portion.

Aspect 32. The toy projectile of any one of the preceding claims, wherein the body is formed from an expanded beaded material.

Aspect 33. The toy projectile of claim 32, wherein the expanded beaded material is one or more of expanded beaded polyethylene, expanded beaded polypropylene, expanded beaded polystyrene, expanded beaded thermoplastic polyurethane, and expanded beaded polylactic acid.

Aspect 34. The toy projectile of any one of the preceding claims, wherein the length of the body is about 60 mm to about 70 mm, and the length of the nub portion is about 3 mm to about 5 mm.

It is noted that throughout the disclosure, words such as "forward," "rearward," "upper," "lower," "top," "bottom," "front," "rear," "above," and "below," as well as like terms, refer to portions of the projectile as they are viewed in the drawings relative to other portions or in relationship to the positions of the projectile as it will be typically used, loaded into and launched from a launching apparatus.

While particular embodiments of the present invention have been shown and described in detail, it will be obvious to those skilled in the art that changes and modifications may be made without departing the from the invention in its broader aspects. Therefore, the aim is to cover all such changes and modifications as fall within the true spirit and scope of the invention. The matters set forth in the foregoing description and accompanying drawings are offered by way of illustration only and not as limitations. The actual scope of the invention is to be defined by the subsequent claims when viewed in their proper perspective based on the prior art.

What is claimed is:

1. A toy projectile, comprising:

a body having a length extending between a first end to an oppositely disposed a second end, wherein the body has a substantially cylindrical shape;

a nub portion extending from the second end, the nub portion having a diameter smaller than a diameter of the body at the second end, such that a step is defined between the second end and the nub portion, wherein the nub portion has a length extending between a first nub end and a second nub end, the first nub end is contiguous with the second body end, and the second nub end terminates in a flat or substantially flat surface;

a tip attached to the body at the first end; and one or more fins attached to or integrally formed with the body at the second end upstream the nub portion.

2. The toy projectile of claim 1, wherein a ratio of the body length to the nub portion length is about 12:1 to about 20:1.

3. The toy projectile of claim 1, comprising 6 fins spaced to surround a circumference of the body.

4. The toy projectile of claim 1, wherein the nub portion length is about 1 to 5 mm.

5. The toy projectile of claim 1, wherein the nub portion comprises a circumferential wall joining a first nub end at the second end and an oppositely disposed second nub end, wherein the circumferential wall tapers inwardly from the first nub end to the second nub end.

6. The toy projectile of claim 5, wherein the circumferential wall has a taper of about 100°.

7. The toy projectile of claim 1, wherein the nub portion comprises a circumferential wall joining a first nub end at the second end and an oppositely disposed second nub end, wherein the circumferential wall is a straight non-tapered wall.

8. The toy projectile of claim 1, wherein the body has a length defined between the first and the second end of about 50 mm to about 100 mm.

9. The toy projectile of claim 1, wherein the body has a reduced diameter portion at the first end and the tip is sized to fit over the reduced diameter portion.

10. The toy projectile of claim 1, wherein the body is formed from an expanded beaded material.

11. The toy projectile of claim 10, wherein the expanded beaded material is one or more of expanded beaded polyethylene, expanded beaded polypropylene, expanded beaded polystyrene, expanded beaded thermoplastic polyurethane, and expanded beaded polylactic acid.

12. The toy projectile of claim 1, wherein the length of the body is about 60 mm to about 70 mm, and the length of the nub portion is about 3 mm to about 5 mm.

13. A toy projectile, comprising a body extending from a first end to a second end, wherein the body has a boat tail structure, such that a diameter of the body tapers from a maximum body diameter towards the second end to define a nub portion having a nub diameter less than the maximum body diameter;

one or more fins disposed on the body adjacent the second end around a circumference of the body, wherein an outer circumference is defined by the outer surface of the one or more fins and a diameter of the outer circumference is substantially the same as the maximum body diameter, wherein the one or more fins are positioned on the body such that the toy projectile has a substantially constant diameter along a length of the toy projectile extending from the maximum body diameter to the one or more fins having the outer circumference;

wherein the one or more fins terminate at fin ends upstream the nub portion, such that the nub portion extends outwardly defining a reduced circumferential portion as compared to an outer circumference defined by the one or more fins and a step is defined between the fin ends and the nub portion.

14. The toy projectile of claim 13, wherein a ratio of the maximum body diameter to the nub diameter is about 10:1 to about 1.25:1.

15. The toy projectile of claim 13, wherein a difference between the maximum body diameter and the nub diameter is about 0.5 mm to about 3 mm.

16. The toy projectile of claim 13, comprising 6 fins spaced to surround a circumference of the body.

17. The toy projectile of claim 13, wherein the nub portion comprises a circumferential wall joining a first nub end at the second end and an oppositely disposed second nub end, wherein the circumferential wall tapers inwardly from the first nub end to the second nub end.

18. The toy projectile of claim 13, wherein the body has a length defined between the first and the second end of about 50 mm to about 100 mm.

19. The toy projectile of claim 13, wherein the body has a reduced diameter portion at the first end and a tip is sized to fit over the reduced diameter portion.

20. The toy projectile of claim 13, wherein the body is formed from an expanded beaded material.

21. The toy projectile of claim 20, wherein the expanded beaded material is one or more of expanded beaded polyethylene, expanded beaded polypropylene, expanded beaded polystyrene, expanded beaded thermoplastic polyurethane, and expanded beaded polylactic acid.

22. A toy projectile, comprising:

a body extending from a first end to a second end;

a plurality of fins attached to or integrally formed with the body at the second end, wherein the body including the fins has a substantially uniform first diameter, each fin being separated from adjacent fins by a space, wherein a portion of the body disposed in the space is tapered inwardly along a length of the fin towards the second end;

a nub portion extending from the second end, wherein nub portion has a second diameter that is less than the first diameter; and a tip attached to the body at the first end.

23. The toy projectile of claim 22, wherein a ratio of the first diameter to the second diameter is about 10:1 to about 1.25:1.

24. The toy projectile of claim 22, wherein a difference between the first diameter and the second diameter is about 0.5 mm to about 3 mm.

25. The toy projectile of claim 22, comprising 6 fins spaced to surround a circumference of the body.

26. The toy projectile of claim 22, wherein the nub portion comprises a circumferential wall joining a first nub end at the second end and an oppositely disposed second nub end, wherein the circumferential wall tapers inwardly from the first nub end to the second nub end.

27. The toy projectile of claim 22, wherein the nub portion comprises a circumferential wall joining a first nub end at the second end and an oppositely disposed second nub end, wherein the circumferential wall is a straight non-tapered wall.

28. The toy projectile of claim 22, wherein the body has a length defined between the first end and the second end of about 50 mm to about 100 mm.

29. The toy projectile of claim 22, wherein the toy projectile is formed from an expanded beaded material, the expended beaded material being one or more of expanded beaded polyethylene, expanded beaded polypropylene, expanded beaded polystyrene, expanded beaded thermoplastic polyurethane, and expanded beaded polylactic acid.

30. The toy projectile of claim 22, wherein the length of the body is about 60 mm to about 70 mm, and a length of the nub portion is about 3 mm to about 5 mm.

* * * * *